US007808168B2

(12) United States Patent
Kuroda et al.

(10) Patent No.: US 7,808,168 B2
(45) Date of Patent: Oct. 5, 2010

(54) SPACER, MANUFACTURING METHOD THEREOF, IMAGE DISPLAY APPARATUS USING THE SPACER, AND MANUFACTURING METHOD THEREOF

(75) Inventors: Kazuo Kuroda, Kamakura (JP); Yasushi Shimizu, Fujisawa (JP); Noriaki Oguri, Zama (JP)

(73) Assignee: Canon Kabushiki Kaisha, Tokyo (JP)

( * ) Notice: Subject to any disclaimer, the term of this patent is extended or adjusted under 35 U.S.C. 154(b) by 394 days.

(21) Appl. No.: 12/106,713

(22) Filed: Apr. 21, 2008

(65) Prior Publication Data

US 2008/0272686 A1 Nov. 6, 2008

(30) Foreign Application Priority Data

Apr. 23, 2007 (JP) ..... 2007-112534

(51) Int. Cl.
*H01J 19/42* (2006.01)
*H01J 63/04* (2006.01)
*H01J 9/24* (2006.01)

(52) U.S. Cl. ..... 313/292; 313/495; 428/323; 445/24

(58) Field of Classification Search ..... 313/292, 313/422, 495–497; 315/169.1–169.2; 445/24, 445/25; 428/323
See application file for complete search history.

(56) References Cited

U.S. PATENT DOCUMENTS

| | | | | |
|---|---|---|---|---|
| 6,512,329 | B1 | 1/2003 | Mitsutake et al. | 313/495 |
| 6,700,321 | B2 | 3/2004 | Mitsutake et al. | 313/495 |
| 6,777,868 | B1 | 8/2004 | Kosaka et al. | |
| 2005/0227062 | A1 | 10/2005 | Sato et al. | |
| 2007/0090742 | A1 * | 4/2007 | Jin | 313/292 |

FOREIGN PATENT DOCUMENTS

| | | |
|---|---|---|
| EP | 0 969 491 | 5/2000 |
| EP | 1 557 863 | 7/2005 |
| JP | 2000-192017 | 7/2000 |
| JP | 2005-235751 | 9/2005 |

* cited by examiner

*Primary Examiner*—Nimeshkumar D Patel
*Assistant Examiner*—Steven Horikoshi
(74) *Attorney, Agent, or Firm*—Fitzpatrick, Cella, Harper & Scinto

(57) ABSTRACT

A spacer for an image display apparatus includes a base material and a film configuration in which a first film having a structure that silver particles are dispersed in aluminum oxynitride and a second film containing tungsten, germanium and nitrogen are layered on the base material in this order.

4 Claims, 10 Drawing Sheets

SPACER, MANUFACTURING METHOD THEREOF, IMAGE DISPLAY APPARATUS USING THE SPACER, AND MANUFACTURING METHOD THEREOF

BACKGROUND OF THE INVENTION

1. Field of the Invention

The present invention relates to a spacer used for a flat image display apparatus, a manufacturing method of this spacer, and an image display apparatus using this spacer, and a manufacturing method of the image display apparatus.

2. Related Background Art

As an image display apparatus that can achieve reduction in thickness and weight, a flat image display apparatus using a surface conduction electron emitting device has been suggested. The image display apparatus using such an electron emitting device forms a vacuum case by arranging a rear plate provided with an electron emitting device and a light emitting member for emitting a light due to irradiation of electrons so as to be opposed to each other and sealing them via a frame material on a periphery. In such an image display apparatus, in order to prevent deformation and damage of a base plate due to a difference of an atmospheric pressure between the inside and the outside of the vacuum case, an atmospheric pressure resistant structure referred to as a spacer is put between the base plates.

The spacer is normally formed in a rectangular sheet shape, and the spacer is arranged with its end portions brought into contact with both base plates so that its surface is in parallel with a normal line of the base plates.

However, when a device in the vicinity of the spacer is activated, the spacer may be charged due to irradiation of a reflection electron to the spacer. The structure that an electron removal film is provided on the surface of the spacer in order to remove this charging is disclosed in Japanese Patent Application Laid-Open (JP-A) No. 2005-235751 (corresponding European Patent Application Laid-Open No. EP A2 1557863) and JP-A No. 2000-192017 (corresponding European Patent Application Laid-Open No. EP A1 0969491).

However, it has been found a phenomenon such that a position of a luminescent spot in the vicinity of a spacer is moved a minute amount when an image display apparatus provided with a conventional spacer has been driven for a long time. In the image display apparatus disclosed in the above-mentioned JP-A No. 2005-235751 and JP-A No. 2000-192017, although the shift amount is very short, it is desired to further decrease the shift amount for a higher-quality picture.

SUMMARY OF THE INVENTION

One object of the present invention is to provide a spacer with small change of charging characteristics even when the image display apparatus has been driven for a long time, and thereby providing an image display apparatus which can decrease movement of a luminescent spot during driving for a long time so as to prevent the adverse effect on the image display apparatus.

The present invention provides a spacer for an image display comprising a base material, and a film configuration in which a first film having a structure that silver particles are dispersed in aluminum oxynitride and a second film containing tungsten, germanium and nitrogen are layered on the base material in this order.

The present invention also provides an image display apparatus with the above-mentioned spacer.

DESCRIPTION OF THE PREFERRED EMBODIMENTS

A first aspect of the present invention may provide a spacer for an image display comprising: a base material; and a film configuration in which a first film having a structure that silver particles are dispersed in aluminum oxynitride and a second film containing tungsten, germanium and nitrogen are layered on the base material in this order.

A second aspect of the present invention may provide an image display apparatus comprising: an airtight container having a first base plate with an electron source arranged thereon and a second base plate with an image display member arranged thereon, the image display member facing the electron source; and a spacer arranged between the first base plate and the second base plate, wherein the spacer has a base material and a film configuration in which a first film having a structure that silver particles are dispersed in aluminum oxynitride and a second film containing tungsten, germanium and nitrogen are layered on the base material in this order.

A third aspect of the present invention may provide a method of manufacturing a spacer for an image display apparatus comprising the steps of: preparing a base material; forming a first film having a structure that silver particles are dispersed in aluminum oxynitride on the base material; and forming a second film containing tungsten, germanium and nitrogen on the first film.

A fourth aspect of the present invention may provide a method of manufacturing an image display apparatus comprising an airtight container having a first base plate with an electron source arranged thereon and a second base plate with an image display member arranged thereon, the image display member facing the electron source, and a spacer arranged between the first base plate and the second base plate, the method comprising the steps of: preparing a base material; forming a first film having a structure that silver particles are dispersed in aluminum oxynitride on the base material; and forming a second film containing tungsten, germanium and nitrogen are layered on the first film.

According to the present invention, even after the image display apparatus has been driven for a long time, change of a resistance of the surface layer of the spacer and change of secondary electron emission efficiency are small and the position of a beam spot of the image display apparatus is not changed from an initial set value, so that the image is stably displayed on a desired position. Therefore, the image display apparatus that can display a high-quality image for a long time is provided.

Figure 1:
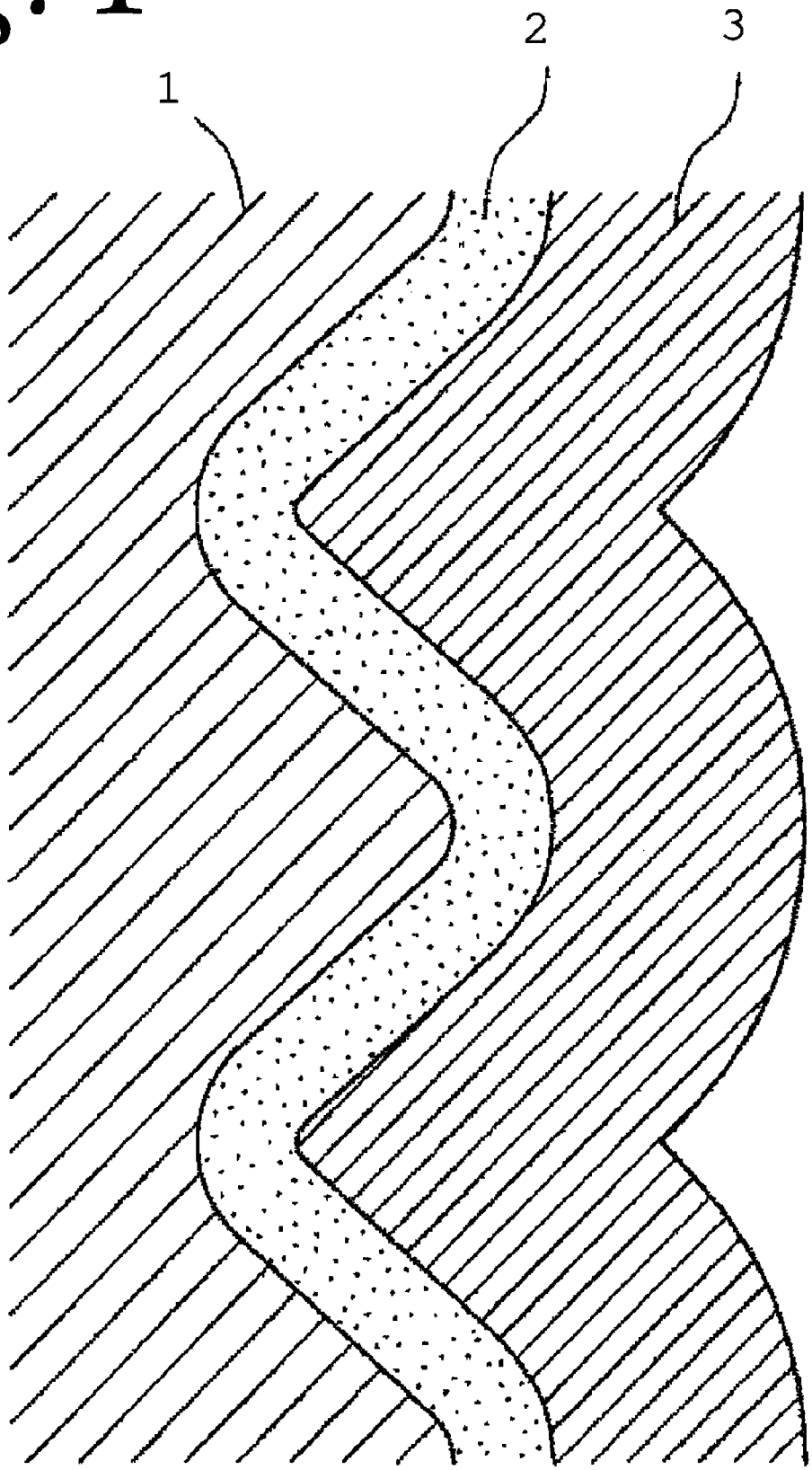
FIG. 1 is a partial sectional view in the vicinity of a surface of a spacer according to the present invention.
Figure 10A:
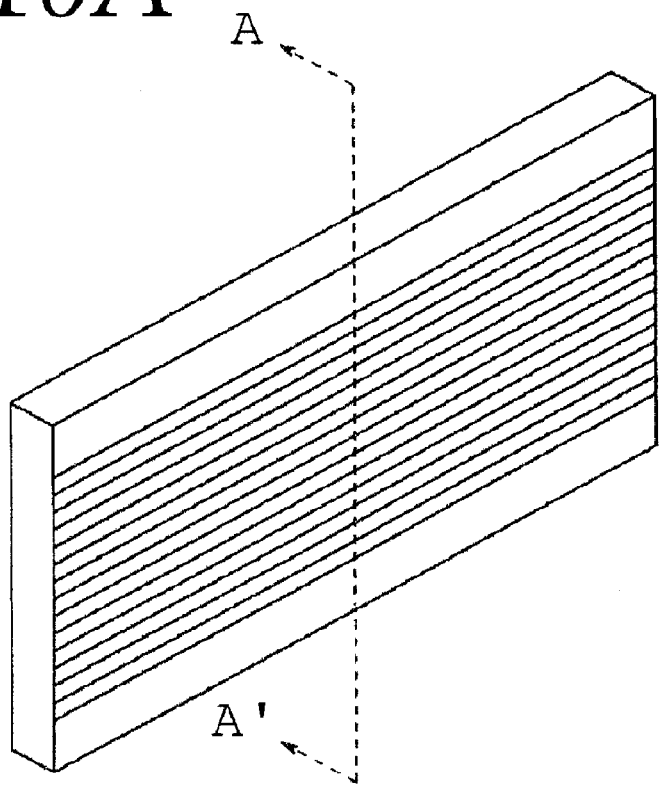
FIG. 10A is a perspective view schematically showing an example of a spacer according to the present invention.
Figure 10B:
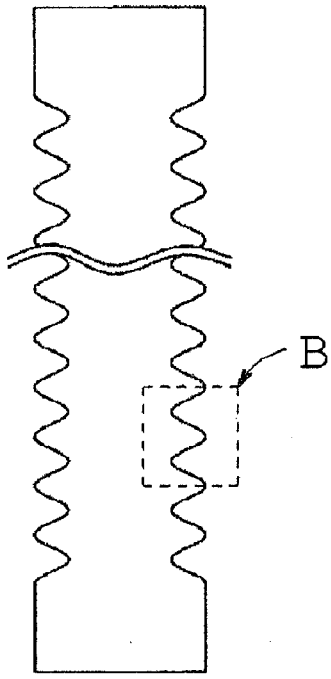
FIG. 10B is a sectional view of an example of a spacer according to the present invention.

FIG. 10A is a perspective view schematically showing an example of a spacer according to the present invention, and FIG. 10B is an A-A' sectional view thereof. FIG. 1 shows an enlarged schematic view in the vicinity of the surface of the spacer shown in FIG. 10B.

The spacer according to the present embodiment has a film configuration such that a first film 2 and a second film 3 are layered on a base material 1 in this order. The base material 1 is a part being responsible for a mechanical strength required for the spacer. This part has only to have a mechanical strength and a consistency with a manufacturing method of the image display apparatus. For example, in the case of passing through a heating step in assembling of the image display apparatus, if a rate of thermal expansion of the spacer is too different from that of other members of the image display apparatus, the image display apparatus may not be assembled well, so that the rate of thermal expansion of the spacer will be appropriately selected in accordance with an assembling process of the image display apparatus.

Removal of electricity on the surface of the spacer is carried out by the first film 2 and the second film 3, so that it is not particularly necessary to supply a current. On the contrary, a base material having a low resistance is not preferable because it causes application of the electron accelerating voltage Va on the upside and downside of the spacer thereby causing excessive current and increased power consumption. A resistance value of the base material 1 needs to be sufficiently higher than that of the first film 2, and preferably, an insulating body such as glass and ceramic is used as base material.

The first film 2 and the second film 3 are provided on the base material 1 in this order according to an arbitrary method such as a vacuum deposition method and a liquid phase method.

According to the present embodiment, the first film 2 has a structure that silver particles are dispersed in aluminum oxynitride and the second film 3 contains tungsten, germanium, and nitrogen.

A conductive property of the spacer according to the present embodiment is decided by silver particles contained in the first film 2. Therefore, a film having a specific resistance that is optimum for the spacer is formed by selecting a particle diameter of the silver particles and a contained amount of silver.

In order to adjust the resistance of the spacer into $\rho=1\times10^{4}$ to $1\times10^{11}$ Ωcm (that is a proper value for the spacer), it is preferable that the particle diameter of the silver particle is in the range of 0.5 to 20 nm and the contained amount of silver is in the range of 8 to 22% of the total in terms of the element ratio. Further preferably, the particle diameter of the silver is in the range of 5 to 10 nm and the contained amount of silver is in the range of 11 to 20%.

Aluminum oxynitride contained in the first film 2 is a high-resistive material. Oxynitride may include a mixture of nitride and oxide or a compound such that one atom has connection to both of nitrogen and oxygen, and a proportion of nitrogen and oxygen is basically arbitrary. When nitride is formed by sputtering, such oxynitride is formed in such a matter that oxygen is naturally taken in a film. And also in the present invention, the film in the range of 0.05 to 0.8 in terms of N/O ratio is preferably used since the film in this range is easily formed.

In the second film 3, tungsten or nitride of tungsten and germanium or nitride of germanium are mixed. Although a main component of a constituent element is basically tungsten, germanium, and nitrogen, oxygen may be partially contained in the film. According to the present invention, the film having oxygen contained in this second film 3 can be also used without problems. In addition, the proportion of tungsten and germanium may have an effect on a film resistance, and in the present invention, a preferable range is 0.2 to 2% of tungsten and 35 to 60% of germanium in terms of the element ratio. In addition, a contained amount of nitrogen may also have an effect on the resistance. It is preferable that there is a contained amount of nitrogen to some extent since the resistance becomes lower if the amount of no-nitride tungsten and germanium are increased. It is preferable that the contained amount of nitrogen is in the range of 40 to 65% in terms of the element ratio.

In addition, according to the present embodiment, a predetermined effect is realized by layering the first film 2 and the second film 3 from the side of the base material 1 in this order.

Next, an image display apparatus using the spacer according to the present embodiment will be described.

Figure 2:
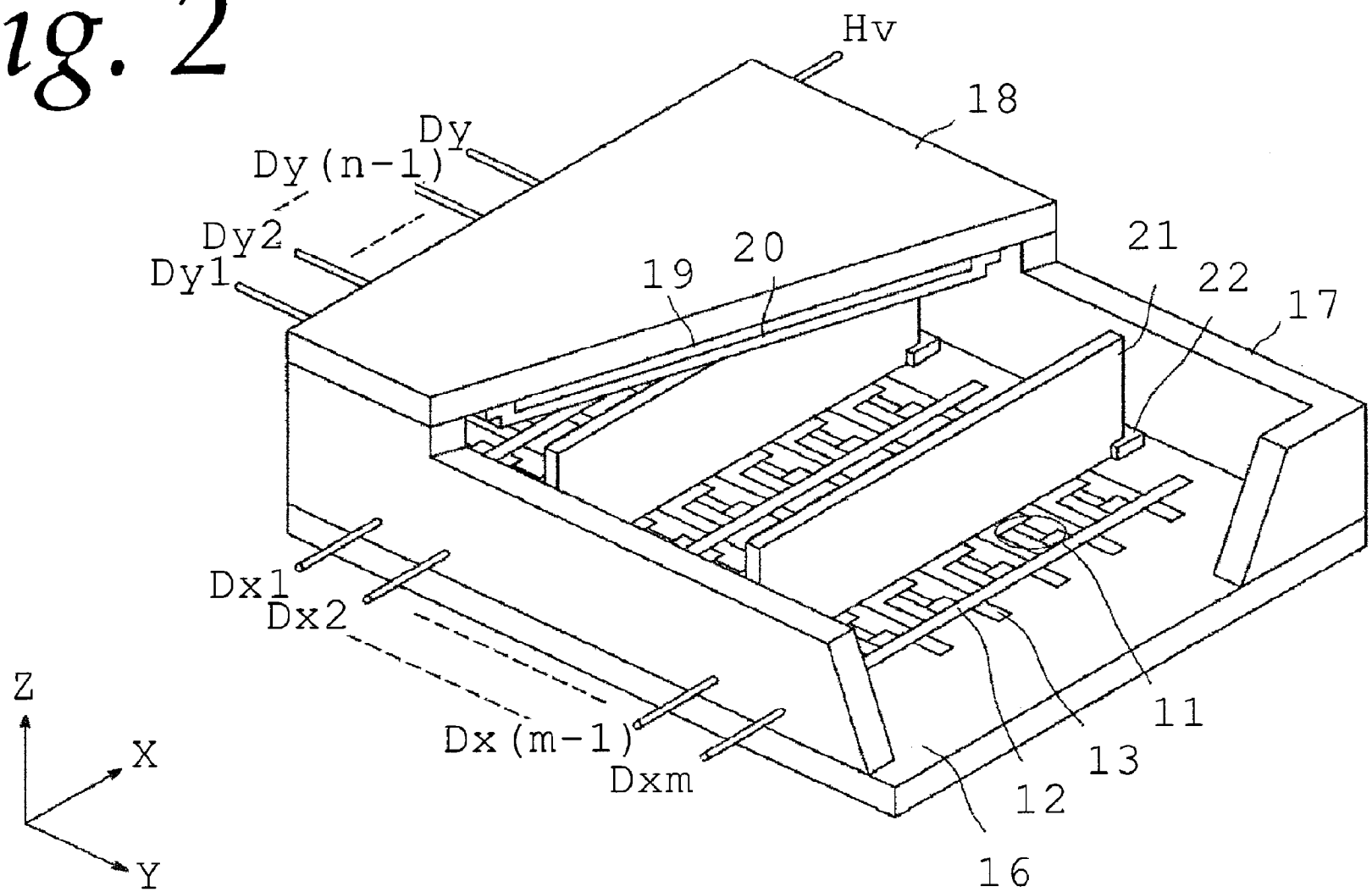
FIG. 2 is a perspective view schematically showing a structure of a display panel of an example of an image display apparatus according to the present invention.

FIG. 2 schematically shows an example of a structure of a display panel of the image display apparatus according to the present embodiment. FIG. 2 illustrates a panel that is partially cutaway in order to indicate the inner structure. In the drawing, a reference numeral 11 denotes an electron emitting device, a reference numeral 12 denotes a row-direction wiring, a reference numeral 13 denotes a column-direction wiring, a reference numeral 16 denotes a rear plate (an electron source base plate), a reference numeral 17 denotes a frame member, a reference numeral 18 denotes a face plate (an anode base plate), a reference numeral 19 denotes a fluorescence film, and a reference numeral 20 denotes a metal back (an anode electrode). In addition, a reference numeral 21 denotes a spacer and a reference numeral 22 denotes a fixing member for the spacer. Further, the first base plate and the second base plate according to the present invention may correspond to any of the rear plate and the face plate, respectively.

According to the present embodiment, the rear plate 16 that functions as the electron source base plate and the face plate 18 that functions as the anode base plate are sealed via the frame member 17 on a periphery so as to form an airtight container. Inside of this airtight container is kept at a vacuum of about $10^{-4}$ Pa, so that a spacer 21 that is formed in a rectangular sheet shape as an atmospheric pressure resistant structure in order to prevent damage due to an atmospheric pressure and an unexpected impact or the like. The spacer 21 is fixed at its end by a fixing member 22 in the outside of an image display area.

In the rear plate 16, N×M pieces of surface conduction electron emitting devices 11 are formed and these surface conduction electron emitting devices are arranged in a simple matrix by M pieces of row-direction wirings 12 and N pieces of column-direction wirings 13 (M and N are positive integers). An intersection of the row-direction wiring 12 and the column-direction wiring 13 is insulated by an interlayer insulating layer (not shown). Further, according to the present embodiment, the structure such that the surface conduction electron emitting devices are arranged in a simple matrix is illustrated, however, the present invention is not limited to this but the present invention is preferably applied in an FE (a field emission type) electron emitting device and an MIM (a metal-insulator-metal type) electron emitting device or the like. In addition, the present invention is not limited to a simple matrix arrangement.

In the structure of FIG. 2, the face plate 18 is provided with the fluorescence film 19 as an image display member, and the metal back 20 as an anode electrode that is known in the technical field of CRT. The fluorescence film 19 is color-coded into three primary colors, namely, Red, Green, and Blue, and a black conductor (a black stripe) is put between respective phosphors of respective colors. The phosphors are arranged in accordance with arrangement of an electron source, for example, in a stripe, a delta, and a matrix.

The spacer 21 to be used for the present embodiment is arranged in parallel with the row-direction wiring 12 that functions as a cathode electrode and is electrically connected to the row-direction wiring 12 and the metal back 20 that functions as the anode electrode, respectively.

In addition, the spacer according to the present invention may be contacted with an anode electrode and an electron source, and a conductive film may be formed on the contact face in addition.

The spacer shown in FIG. 2 is formed in a rectangular sheet shape and this spacer is preferably used in the present invention, however, the present invention is not limited to this shape but a columnar shape or the like can be appropriately selected in the range where the same effect can be obtained.

EXAMPLE

Next, a manufacturing method of a display panel of the image display apparatus to which the present invention is applied will be described with reference to FIG. 2 and FIG. 3 illustrating a specific example.

(Step for Manufacturing Spacer)

Figure 5A:
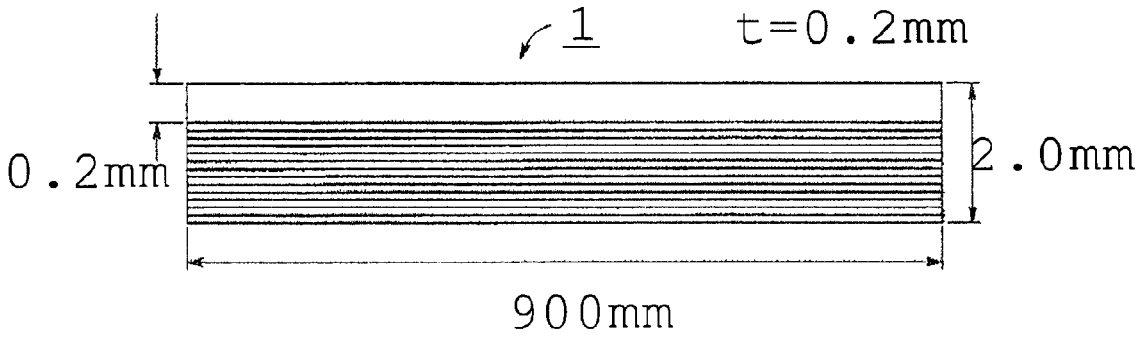
FIGS. 5A and 5B are views showing a shape of the spacer that is used for the embodiments of the present invention.
Figure 5B:
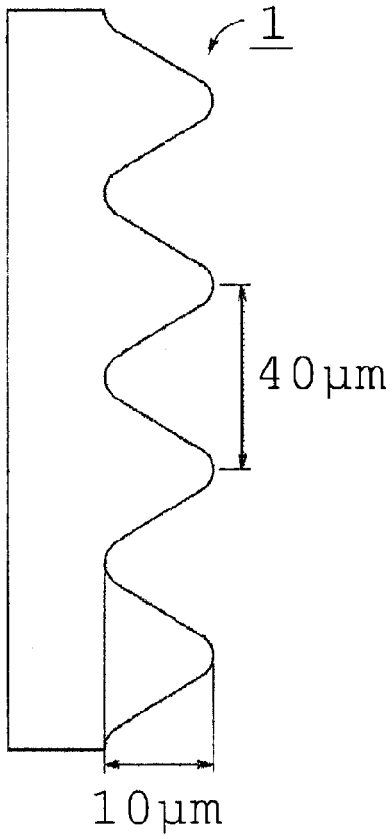

As a base material 1, a low-alkali glass for display, PD200, which is manufactured by Asahi Glass Co., Ltd. is used. Using this material, the base material 1 shown in FIG. 5 is manufactured by a heat drawing method. FIG. 5A is a plan view of the base material 1 and FIG. 5B is a sectional partial schematic view of the surface portion of the base material 1. According to the present example, the height of the spacer 21 is defined to be 2 mm and a length in a longitudinal direction is defined to be 900 mm.

According to the present example, concavity and convexity formed in a stripe along a longitudinal direction are provided on the surface of the base material 1. The shape of the concavity and convexity is a substantially sine wave shape as shown in FIG. 5B and a pitch is 40 μm and a depth is 10 μm. In addition, on the upper part of the base material (the side to be joined to the face plate), an area where a concavo-convex groove is not formed is made and the width thereof is defined to be 200 μm from the upper end of the base material.

On this base material 1, the first film 2 and the second film 3 are layered by sputtering.

First, the dual-target co-sputtering on the base material 1 is carried out using silver and aluminum as targets thereof, and the composition of the film is adjusted by means of changing an input power to be given to each target. The conditions for forming the first film 2 used for the present embodiment are shown in a table 1. There are three film forming conditions, namely, first to third conditions, and thereby, films having three kinds of film thickness are manufactured.

Next, the dual-target co-sputtering is carried out using tungsten and germanium as targets thereof and a composition of the film is adjusted by means of changing an input power to be given to each target, and thus the second film 3 is layered on the first film 2. The conditions for forming the second film 3 used for the present embodiment is shown in a table 2. There are five film forming conditions, namely, forth to eighth conditions, and thereby, films having five kinds of film thickness are manufactured.

Combining respective film forming conditions of the first film 2 and the second film 3, spacer samples a to g as shown in a table 3 are manufactured. The first film 2 and the second film 3 are formed on both of the front and back surfaces of the base material 1 in the same way, respectively.

TABLE 1

| Film Forming Cond. | Size of Target | Input Power Ag (W) | Input Power Al (W) | Pressure (Pa) | $N_2$ (sccm) | $O_2$ (sccm) | Distance btwn Base Plate and Target (mm) | Time for Film Forming (min) | Film Thickness (nm) |
|---|---|---|---|---|---|---|---|---|---|
| 1 | 8 inch$^{\Phi}$ | 97 | 2400 | 0.5 | 98 | 2 | 153 | 22 | 80 |
| 2 | 8 inch$^{\Phi}$ | 91 | 2400 | 0.5 | 98 | 2 | 153 | 45 | 150 |
| 3 | 8 inch$^{\Phi}$ | 88 | 2400 | 0.5 | 98 | 2 | 153 | 100 | 300 |

TABLE 2

| Film Forming Cond. | Size of Target | Input Power W (W) | Input Power Ge (W) | Pressure (Pa) | $N_2$ (sccm) | Distance btwn Base Plate and Target (mm) | Time for Film Forming (min) | Film Thickness (nm) |
|---|---|---|---|---|---|---|---|---|
| 4 | 8 inch$^{\Phi}$ | 400 | 1200 | 0.5 | 100 | 240 | 6.2 | 50 |
| 5 | 8 inch$^{\Phi}$ | 400 | 1200 | 0.5 | 100 | 240 | 70 | 600 |
| 6 | 8 inch$^{\Phi}$ | 400 | 1200 | 0.5 | 100 | 240 | 140 | 1200 |
| 7 | 8 inch$^{\Phi}$ | 400 | 1200 | 0.5 | 100 | 240 | 233 | 2000 |
| 8 | 8 inch$^{\Phi}$ | 400 | 1200 | 0.5 | 100 | 240 | 291 | 2500 |

TABLE 3

| Cond. for $1^{ST}$ Film | Cond. for $2^{ND}$ Film 4 (t = 50 nm) | 5 (t = 600 nm) | 6 (t = 1200 nm) | 7 (t = 2000 nm) | 8 (t = 2500 nm) |
|---|---|---|---|---|---|
| 1 (t = 80 nm) | — | — | f | — | — |
| 2 (t = 150 nm) | a | b | c | d | e |
| 3 (t = 300 nm) | — | — | g | — | — |

(Rear Plate Step)

<Step 1: Formation of Wirings and Electrodes>

Figure 3A:
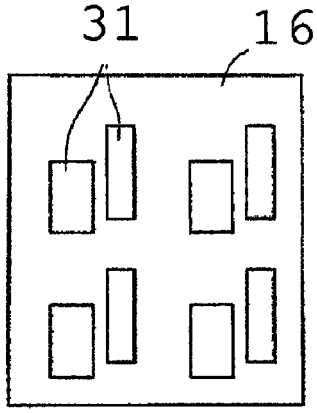
FIGS. 3A to 3E are plan schematic views showing a manufacturing step of a rear plate according to the embodiment of the present invention.

As the rear plate 16, a $SiO_2$ layer of a thickness 0.5 μm is formed on a surface of a cleaned blue plate glass by sputtering, and device electrodes 31 of surface conduction electron emitting devices are formed by using sputtering and a photolithography method. A material is obtained by layering Ti and Ni. In addition, an interval between the device electrodes is defined to be 2 μm (FIG. 3A).

Figure 3B:
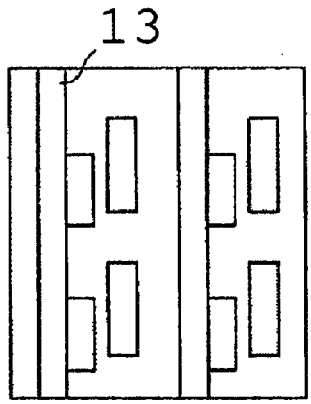

Subsequently, printing Ag paste in a predetermined shape and burning it, the column-direction wirings 13 are formed and extended up to the outside of the area where the electron sources are formed to be made into wirings for driving the electron sources (FIG. 3B).

Figure 3C:
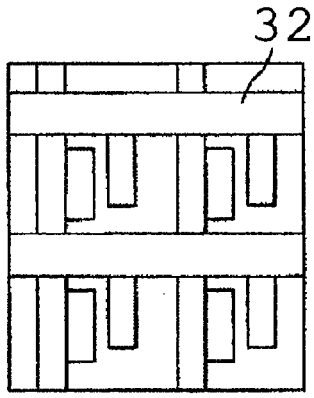

Next, using PbO as a main component and using paste having glass binder mixed, an insulating layer 32 is formed according to a print method in the same way. This insulating layer 32 may insulate the above-mentioned column-direction wirings 13 and the after-mentioned row-direction wirings 12. Further, forming a notch on the device electrode 31, the row-direction wirings 12 are connected to the device electrodes 31 (FIG. 3C).

Figure 3D:
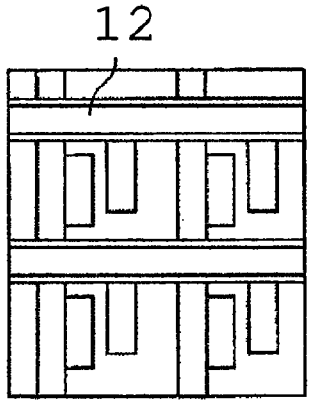

Subsequently, the row-direction wirings 12 are formed on the insulating layer 32 (FIG. 3D). The method is the same as the case of the column-direction wirings 13.

<Step 2: Manufacturing of Electron Source Base Plate>

Figure 3E:
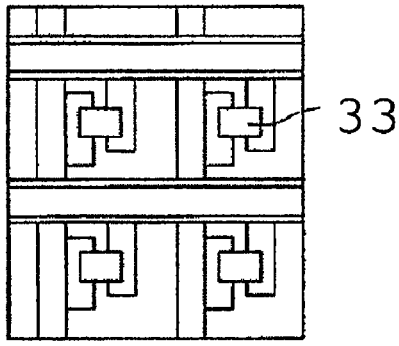

Subsequently, a device film 33 made of PdO is formed. As to a method of forming the device film 33, a Cr film is formed by sputtering on the rear plate 16 having the row-direction wirings 12 and the column-direction wirings 13 formed thereon, and an opening portion corresponding to the shape of the device film 33 is formed by a photolithography method on the Cr film. Next, applying a solution of an organic Pd complex compound and burning it at 300° C. in atmosphere, a PdO film is formed and then, removing the Cr film by wet etching, the device film 33 in a predetermined shape is obtained by lifting-off (FIG. 3E).

According to the present example, in the above-mentioned N×M pieces of electron emitting devices, N is set to 2400 and M is set to 800. In addition, respective devices are arranged at intervals of 200 μm in an X direction and at intervals of 600 μm in a Y direction.

(Face Plate Step)

<Step 1: Manufacturing of Anode Electrode>

On the cleaned glass base plate, the anode electrode 20 is manufactured. On the anode electrode 20, an ITO that is a transparent conductive film is formed by spattering.

<Step 2: Manufacturing of Fluorescence Film>

Figure 4A:
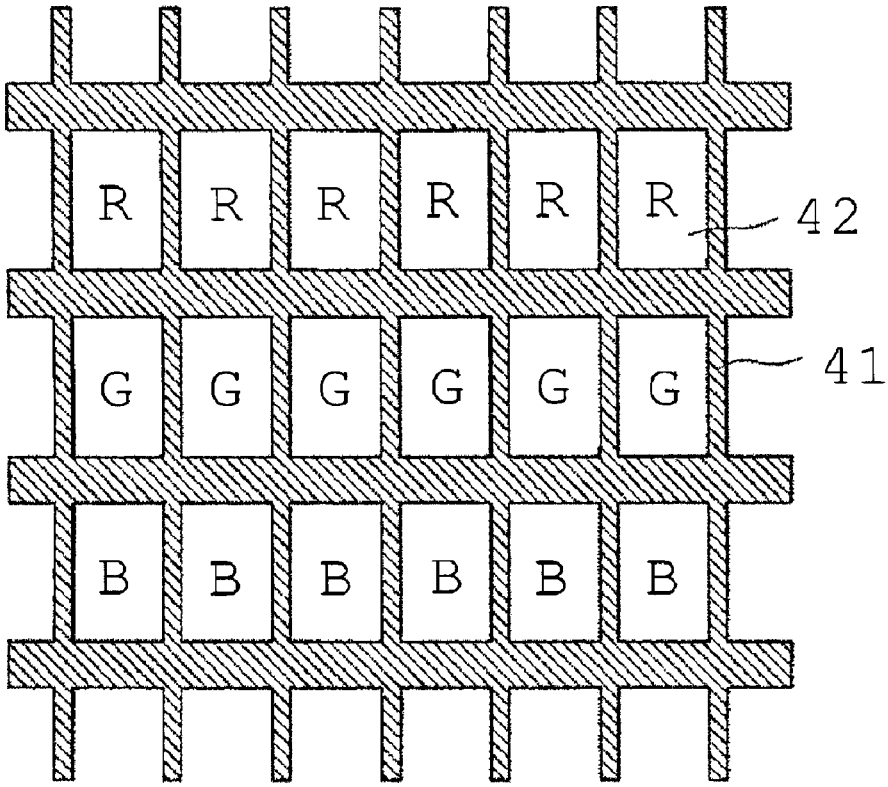
FIGS. 4A and 4B are plan schematic views showing a fluorescence film of a face plate that is used for the image display apparatus according to the present invention.
Figure 4B:
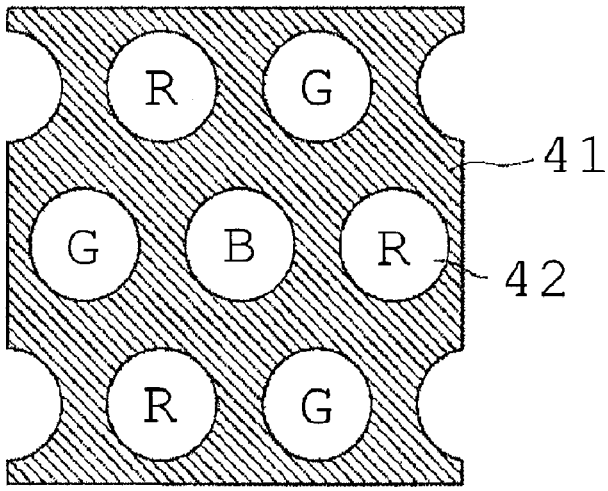

This step will be described with reference to FIG. 4. Using glass paste and paste containing black pigment and silver particles, a black matrix 41 in matrix shape as shown in FIG. 4A is manufactured with a thickness 10 μm by a screen print method. In addition, the black matrix 41 is provided in order to prevent color mixture of a phosphor, to prevent a color drift even when a beam is shifted in some degree, and to improve a contrast of an image absorbing outside light and the like. According to the present example, the black matrix 41 is manufactured by the screen print method, however, it is a matter of course that the present invention is not limited to this but the black matrix 41 may be manufactured, for example, by using a photolithography method. In addition, as a material of the black matrix 41, glass paste and paste containing black pigment and silver particles are used, however, it is a matter of course that the present invention is not limited to this but, for example, a carbon black or the like may be used. In addition, according to the present example, the black matrix 41 is manufactured in a matrix shape as shown in FIG. 4A, however, it is a matter of course that the present invention is not limited to this but arrangement in a delta as shown in FIG. 4B, arrangement in a stripe (not shown), and other arrangements may be used.

Next, as shown in FIG. 4A, on opening portions of the black matrix 41, three-colored phosphors 42 are made in three times for each color using phosphor paste of red, blue, and green by a screen print method. According to the present example, the fluorescence film 19 is manufactured by using a screen print method, however, it is a matter of course that the present invention is not limited to this but the fluorescence film 19 may be manufactured, for example, using a photolithography method or the like. In addition, as the phosphor, a phosphor of P22 that has been used in a field of CRT is used and red (P22-RE3; $Y_2O_2S:Eu^{3+}$), blue (P22-B2; ZnS:Ag,Al), and green (P22-GN4; ZnS:Cu,Al) are used. In the present invention, the phosphor is not limited to this but other phosphor may be used.

(Integration (Sealing) Step)

<Sealing Step>

Upon assembling of an airtight container, it is necessary to seal the airtight container in order to maintain a sufficient strength and air tightness on a joining portion of each member. According to the present example, by applying frit glass on the joining portion at first and burning it for more than ten minutes in the range of 400 to 500° C. in a nitrogen atmosphere, the frame member 17 as shown in FIG. 2 and the rear plate 16 are bonded together.

After that, the spacer 21 manufactured in the above-mentioned step is fixed to the rear plate 16. Twenty spacers 21 in total are arranged at equal intervals and the above-mentioned spacers a to g are included. As to a fixing method, the spacer 21 is fixed using a spacer fixing member 22 on the side of the rear plate 16 of both end portions in a longitudinal direction of the spacer 21. These fixing portions are located outside of the image area and it does not have an adverse effect on a quality of an image. In addition, according to the present example, the spacers 21 are fixed on the side of the rear plate 16, however, it is a matter of course that the present invention is not limited to this. For example, the spacers may be fixed on the side of the face plate 18 or the spacers that can stand on for itself may be used.

After that, by using In, which is low-melting point metal, and heating the face plate 18 and the frame member 17 up to 160° C. in inactive atmosphere, the face plate 18 and the frame member 17 are bonded together and sealing of the airtight container has been completed.

In order to discharge air inside of the airtight container up to vacuum, after assembling the airtight container, the airtight container is connected to an exhaust pipe (not shown) with a vacuum pump and the air therein is discharged up to a degree of vacuum about $10^{-5}$ Pa. After that, the exhaust pipe is sealed and in this case, in order to maintain a degree of vacuum in the airtight container, a getter film (not shown) is formed on a predetermined position in the airtight container just before sealing or after sealing. The getter film is formed by deposition, where a getter material having Ba, for example, as a main component is heated using a heater or a high-frequency heating. The inside of the airtight container is maintained at a degree of vacuum in the range of $1\times10^{-3}$ to $1\times10^{-5}$ Pa due to an absorption effect of the getter film.

According to the present example, after connecting the airtight container to a vacuum exhaust apparatus (not shown) to discharge air in the airtight container and when the pressure becomes $10^{-4}$ Pa or less, forming processing is carried out. The forming step is carried out by applying a pulse voltage, of which pulse height is increased step by step in a row-direction wiring, for each row in a row direction. Measuring a current value of a pulse for forming and measuring a resistance value of an electron emitting device at the same time, the forming processing of the row is terminated when the resistance value for each device exceeds 1 MΩ and the processing is shifted to that of a next row. Repeating this, the forming processing is terminated for all rows.

Subsequently, activating processing is carried out. Prior to this processing, lowering a pressure of the above-mentioned vacuum apparatus $10^{-5}$ Pa or less and introducing acetone in the vacuum apparatus, an introduction amount of acetone is adjusted so that the pressure becomes $1.3\times10^{-2}$ Pa. Subsequently, a pulse voltage is applied to the row-direction wiring 12. Shifting the row-direction wiring 12 to which a pulse is added for each pulse to a next row, applying of a pulse to each wiring in rows is repeated in series. As a result of this processing, a deposit film having a carbon as a main component is formed in the vicinity of an electron emitting portion of each electron emitting device and a device current If and an emission current Ie are increased. Thus, an electron source base plate of the image display apparatus is completed.

A method of evaluating the image of the obtained image display apparatus is carried out as follows.

(Evaluation Method of Image)

By driving the image display apparatus for a long time, if some changes are caused in the spacer, an orbit of a beam is disturbed and a position of a lighting pixel, which should be displayed at equal intervals, is shifted. In this case, defining the interval L of the original beam position to be 1 L, this is defined as a unit of beam shift amount. In the case that the position of the beam spot is shifted due to change of the spacer, a difference between the proper display position and the display position in practice is indicated in terms of L, and it is noted as ΔL. According to the present example, a device pitch in a Y direction is 600 μm, so that 1 L is made into 600 μm.

Setting the display apparatus in a room having a sufficient light, visual evaluation of the displayed image from one meter away from the panel face is carried out for examinees of fifty adult men and women.

Evaluating disturbance of an image due to shift of the beam in three stages, namely, "cannot see disturbance", "can see the disturbance, but not feel uneasy", and "can see the disturbance and feel uneasy", a relation with shift amount of the beam ΔL is obtained. Shift amount of the beam ΔL in which majority of the examinees answered that "cannot see disturbance" is 0 or more and 0.01 L or less; shift amount of the beam ΔL in which majority of the examinees answered that "can see the disturbance, but not feel uneasy" is more than 0.01 L and 0.03 L or less; and shift amount of the beam ΔL in which majority of the examinees answered that "can see the disturbance and feel uneasy" is more than 0.03 L. Evaluation results are shown in a table 4.

TABLE 4

| Visual Evaluation | Beam Shift Amount ΔL | Beam Shift Amount (%) | Evaluation |
|---|---|---|---|
| cannot see | 0 or more and 0.01 L or less | 0 or more and 1% or less | ◎ |
| can see but not feel uneasy | more than 0.01 L and 0.03 L or less | more than 1% and 3% or less | ○ |
| can see and feel uneasy | more than 0.03 L | more than 3% | X |

A performance evaluation of the resistance film of the present invention is carried out by image evaluation such that the spacer provided with this resistance film is set in the display apparatus and shift amount of the beam ΔL due to the effect of the spacer is measured.

In addition, carrying out this evaluation two times in total before and after longtime driving, the values in two times are compared. A condition of longtime driving is as follows: an electron acceleration voltage is 10 kV, all devices are lighted (white display), and the apparatus is continuously driven for 1,000 hours. In this case, electron emission amount per device is set at 3 μA.

Next, a method of measuring beam shift amount will be described.

Measurement is carried out by changing an image display gradation for a pixel nearest to the spacer and measuring a beam spot barycentric position of a beam in this time, respectively.

Figure 6:
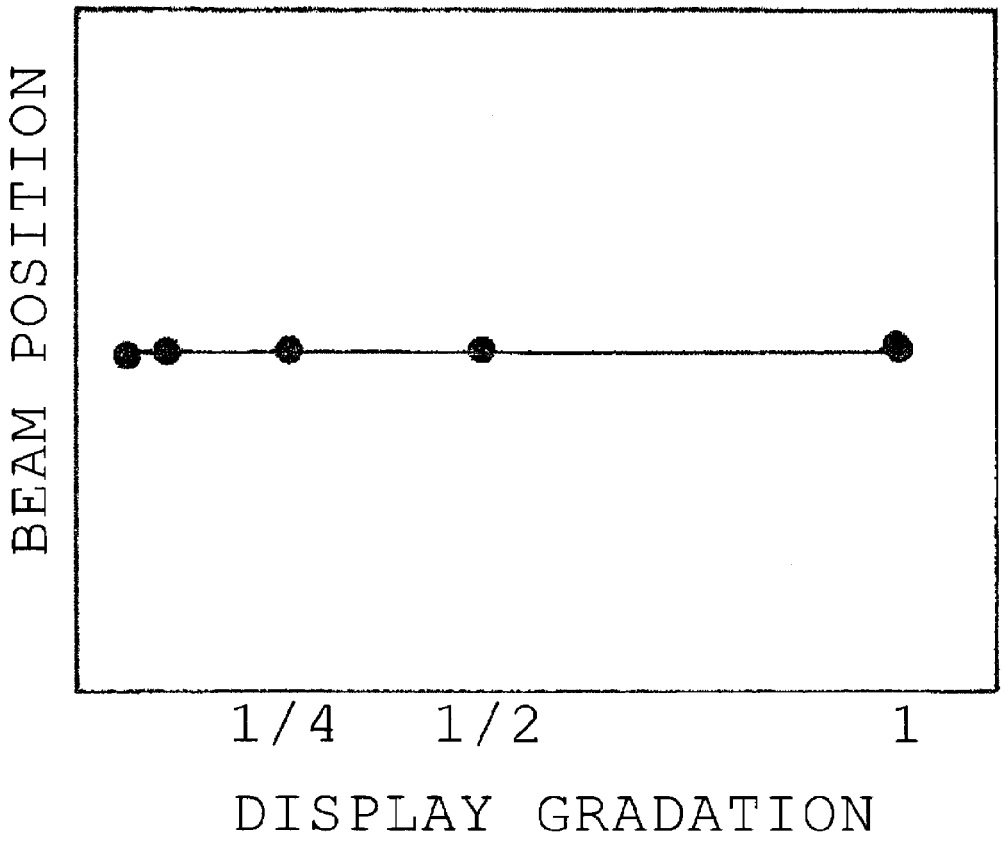
FIG. 6 is an explanatory view showing movement of a beam position due to a display gradation and a continuous driving of a device nearest to the spacer.

As shown in FIG. 6, defining the highest luminance gradation of the display apparatus to be 1, the beam spot barycentric position when the luminance gradation of the display apparatus is indicated by ½ gradation, ¼ gradation, ⅛ gradation, and 1/16 gradation is measured.

Basically, the beam is designed so as to be displayed on a proper position without depending on a display gradation, so that a profile as shown in FIG. 6 is indicated.

On the contrary, if some change is generated in the spacer, any of the following changes is generated.

Figure 7:
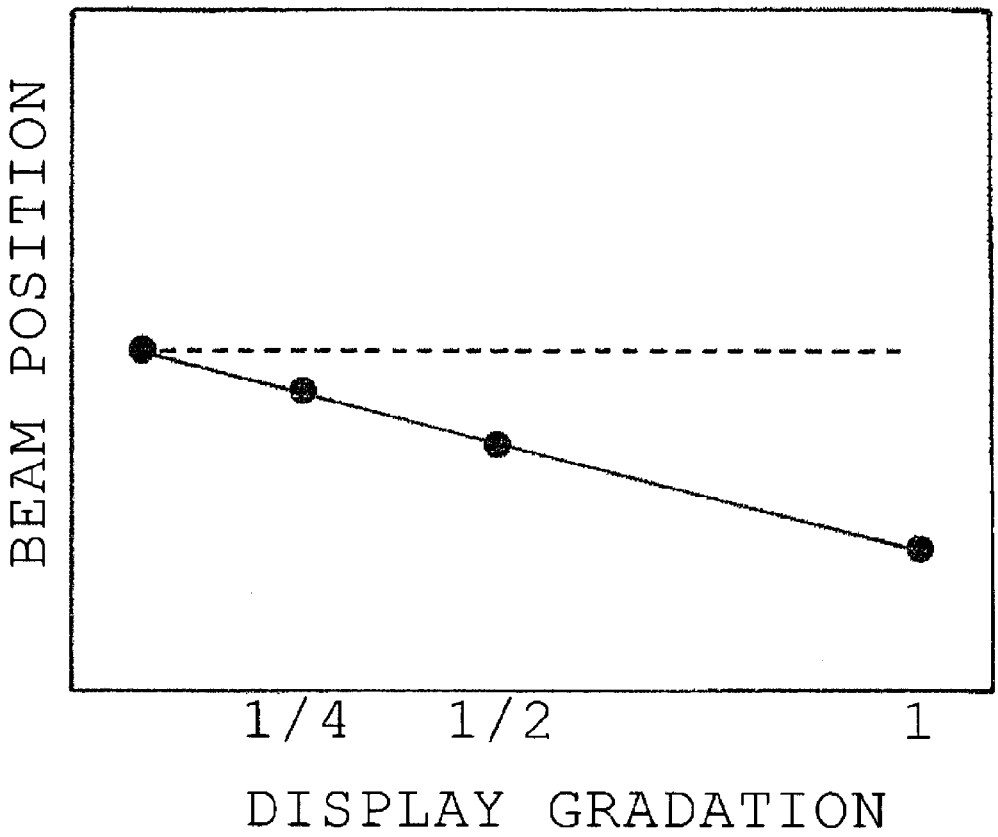
FIG. 7 is an explanatory view showing movement of a beam position due to a display gradation and a continuous driving of a device nearest to the spacer.

(a) As shown in FIG. 7, a beam position of a high gradation side (1 gradation) is changed.

Figure 8:
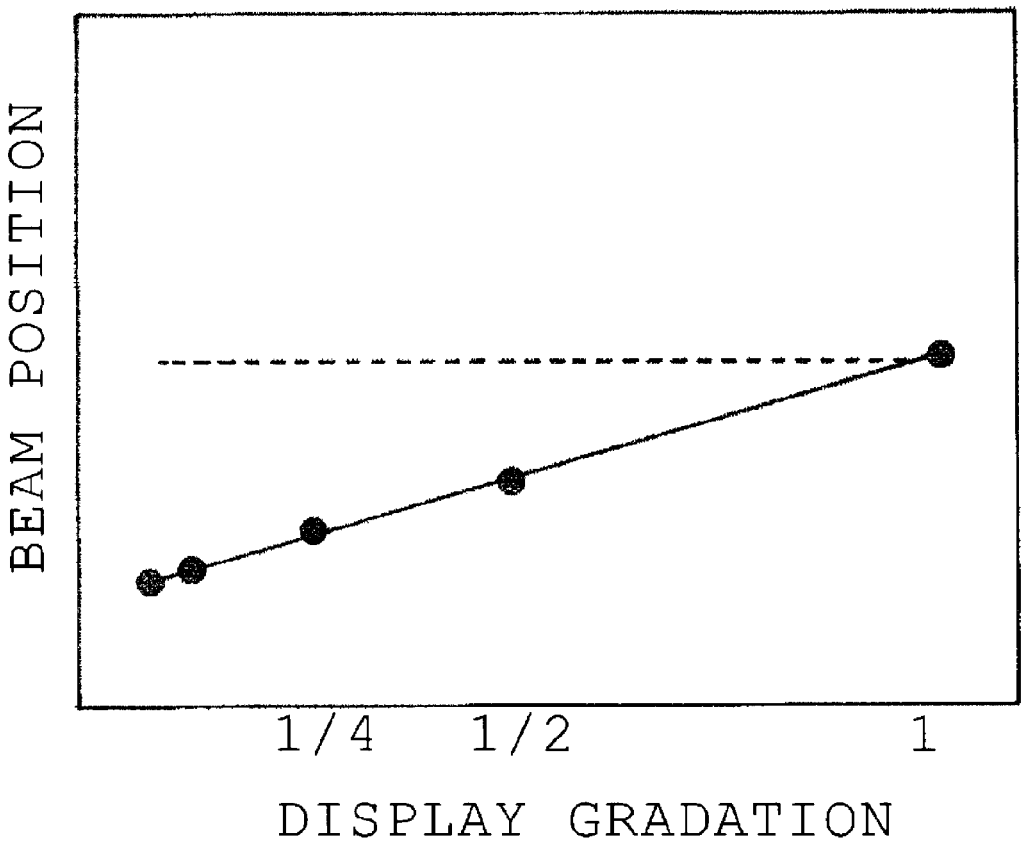
FIG. 8 is an explanatory view showing movement of a beam position due to a display gradation and a continuous driving of a device nearest to the spacer.

(b) As shown in FIG. 8, a beam position of a low gradation side (1/16 gradation) is changed.

Figure 9:
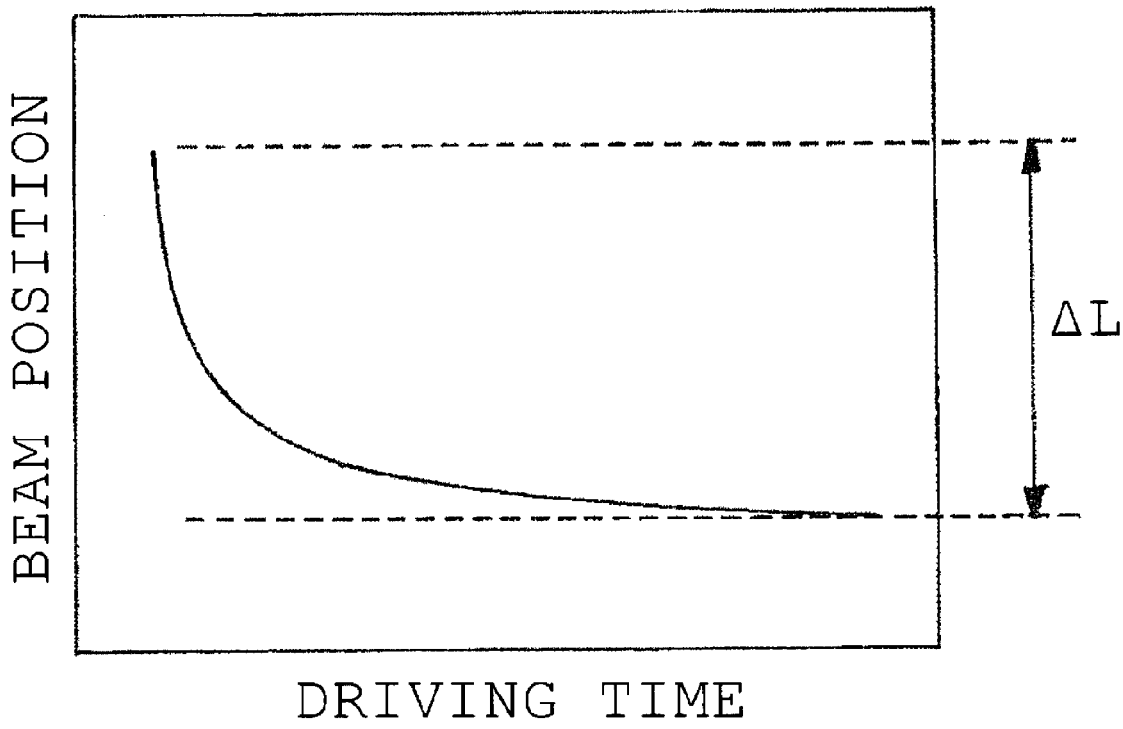
FIG. 9 is an explanatory view showing movement of a beam position due to a display gradation and a continuous driving of a device nearest to the spacer.

In other words, in any of (a) and (b), a phenomenon as shown in FIG. 9 is observed. ΔL in this case is measured.

According to the present example, assembling of the image display apparatus is terminated and the image evaluation measurement is carried out two times in total, namely, before longtime driving and after the apparatus has been continuously driven for 1,000 hours.

The results are shown in a table 5.

At first, under any condition of a to g, the beam position before longtime driving does not depend on a display gradation and a distance between the beam spot barycentric position of 1 gradation and that of 1/16 gradation is ΔL<0.001 L (a measurement limit or less). As a result, the display apparatus has been continuously displaying a high-quality image.

Next, the beam positions before and after longtime driving are compared.

On a high gradation display (1 gradation), a distance between the beam spot barycentric position of before longtime driving and that of after longtime driving is ΔL<0.001 L (a measurement limit or less), and the display apparatus has been continuously displaying a high-quality image.

In addition, on a low gradation display (1/16 gradation), a distance between the beam spot barycentric position of before longtime driving and that of after longtime driving is ΔL<0.001 L (not more than a measurement limit), and the display apparatus has been continuously displaying a high-quality image.

TABLE 5

| Sample No. | Initial ΔL (1 to 1/16 gradations) | ΔL on displaying high gradation (1 gradation) (difference between before and after driving) | ΔL on displaying low gradation (1/16 gradation) (difference between before and after driving) |
|---|---|---|---|
| a | <0.001 L | <0.001 L | <0.001 L |
| b | <0.001 L | <0.001 L | <0.001 L |
| c | <0.001 L | <0.001 L | <0.001 L |
| d | <0.001 L | <0.001 L | <0.001 L |
| e | <0.001 L | <0.001 L | <0.001 L |
| f | <0.001 L | <0.001 L | <0.001 L |
| g | <0.001 L | <0.001 L | <0.001 L |

Comparative Example 1

As a comparative example 1, a spacer made of a single layer structure having one of the first film 2 and the second film 3 is manufactured under each film forming condition as same as in the embodiment, respectively. The image display apparatus is manufactured in same way as the embodiment, and the image evaluation measurement of the obtained image display apparatus is carried out in same way as the embodiment. The results are shown in the table 6.

TABLE 6

| Sample No. | Kinds of Film | Film Forming Cond. | Initial ΔL (1 to 1/16 gradations) | ΔL on displaying high gradation (1 gradation) (difference between before and after driving) | ΔL on displaying low gradation (1/16 gradation) (difference between before and after driving) |
|---|---|---|---|---|---|
| h | First | 1 | <0.001 L | <0.001 L | ≈0.020 L |
| i | Film | 2 | <0.001 L | <0.001 L | ≈0.020 L |
| j | | 3 | <0.001 L | <0.001 L | ≈0.011 L |
| k | Second | 4 | <0.001 L | ≈0.020 L | <0.001 L |
| l | Film | 5 | <0.001 L | ≈0.020 L | <0.001 L |
| m | | 6 | <0.001 L | ≈0.020 L | <0.001 L |
| n | | 7 | <0.001 L | ≈0.020 L | <0.001 L |
| o | | 8 | <0.001 L | ≈0.020 L | <0.001 L |

In samples h, i, and j, comparing the beam spot barycentric positions on displaying a low gradation before and after longtime driving, shift about from 0.011 L to 0.020 L is observed. This is a level that majority of the examinees feel that "can see the disturbance of the image due to beam shift, but not feel uneasy" and this leads to a result that shift amount of the beam is larger than that of the embodiment although this is not a problem for formation of an image.

In addition, in samples k to o, comparing the beam spot barycentric positions on displaying a high gradation before and after longtime driving, shift about nearly equal 0.020 L is observed. This is a level that majority of the examinees feel that "can see the disturbance of the image due to beam shift, but not feel uneasy" and this leads to a result that shift amount of the beam is larger than that of the embodiment although this is not a problem for formation of an image.

Comparative Example 2

As a comparative example 2, a spacer having a layer structure in which the first film 2 and the second film 3 are layered in the reverse order compared with the embodiment, is manufactured under each film forming condition. That is, the first film 2 on the base material 1 is a film containing tungsten, germanium and nitrogen and the second film 3 on the first film 2 is a film having a structure that silver particles are dispersed in aluminum oxynitride. Each manufactured sample is shown in table 7.

TABLE 7

| Cond. for $1^{ST}$ Film | Cond. for $2^{ND}$ Film: 1 (t = 80 nm) | 2 (t = 150 nm) | 3 (t = 300 nm) |
|---|---|---|---|
| 4 (t = 50 nm) | — | p | — |
| 5 (t = 600 nm) | — | q | — |
| 6 (t = 1200 nm) | u | r | v |
| 7 (t = 2000 nm) | — | s | — |
| 8 (t = 2500 nm) | — | t | — |

The image display apparatus is manufactured in the same way as in the embodiment, and the image evaluation measurement of the obtained image display apparatus is carried out in the same way as in the embodiment. The results are shown in table 8.

TABLE 8

| Sample No. | Initial ΔL (1 to 1/16 gradations) | ΔL on displaying high gradation (1 gradation) (difference between before and after driving) | ΔL on displaying low gradation (1/16 gradation) (difference between before and after driving) |
|---|---|---|---|
| p | <0.001 L | <0.001 L | ≈0.012 L |
| q | <0.001 L | <0.001 L | ≈0.012 L |
| r | <0.001 L | <0.001 L | ≈0.012 L |
| s | <0.001 L | <0.001 L | ≈0.012 L |
| t | <0.001 L | <0.001 L | ≈0.012 L |
| u | <0.001 L | <0.001 L | ≈0.012 L |
| v | <0.001 L | <0.001 L | ≈0.011 L |

In samples p to v, comparing the beam spot barycentric positions on displaying a low gradation before and after long-time driving, shift about from 0.011 L to 0.012 L is observed. This is a level that majority of the examinees feel that "can see the disturbance of the image due to beam shift, but not feel uneasy" and this leads to a result that shift amount of the beam is larger than that of the embodiment although this is not a problem for formation of an image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-112534, filed Apr. 23, 2007 which is hereby incorporated by reference herein in its entirety.

What is claimed is:

1. A spacer for an image display apparatus comprising:

a base material; and a film configuration in which a first film having a structure that silver particles are dispersed in aluminum oxynitride and a second film containing tungsten, germanium and nitrogen are layered on the base material in this order.

2. An image display apparatus comprising:

an airtight container having a first base plate with an electron source arranged thereon and a second base plate with an image display member arranged thereon, the image display member facing the electron source; and a spacer arranged between the first base plate and the second base plate, wherein the spacer has a base material and a film configuration in which a first film having a structure that silver particles are dispersed in aluminum oxynitride and a second film containing tungsten, germanium and nitrogen are layered on the base material in this order.

3. A method of manufacturing a spacer for an image display apparatus comprising the steps of:

preparing a base material;

forming a first film having a structure that silver particles are dispersed in aluminum oxynitride on the base material; and forming a second film containing tungsten, germanium and nitrogen on the first film.

4. A method of manufacturing an image display apparatus comprising an airtight container having a first base plate with an electron source arranged thereon and a second base plate with an image display member arranged thereon, the image display member facing the electron source, and a spacer arranged between the first base plate and the second base plate, the method comprising the steps of:

preparing a base material;

forming a first film having a structure that silver particles are dispersed in aluminum oxynitride on the base material; and forming a second film containing tungsten, germanium and nitrogen on the first film.

* * * * *